US007977611B2

(12) United States Patent
DeMichael et al.

(10) Patent No.: US 7,977,611 B2
(45) Date of Patent: Jul. 12, 2011

(54) SYSTEMS AND METHODS FOR PROVIDING LOCALIZED HEAT TREATMENT OF METAL COMPONENTS

(75) Inventors: Thomas DeMichael, Stafford Springs, CT (US); Michael J. Labbe, Hebron, CT (US)

(73) Assignee: United Technologies Corporation, Hartford, CT (US)

( * ) Notice: Subject to any disclaimer, the term of this patent is extended or adjusted under 35 U.S.C. 154(b) by 876 days.

(21) Appl. No.: 11/780,000

(22) Filed: Jul. 19, 2007

(65) Prior Publication Data

US 2009/0020523 A1 Jan. 22, 2009

(51) Int. Cl.
*H05B 3/10* (2006.01)
*C23C 16/00* (2006.01)

(52) U.S. Cl. ..... 219/553; 219/121.65; 219/121.67; 427/252; 427/253; 427/250; 427/142; 427/287; 428/155; 29/889.1; 29/889.7; 29/889.72; 29/402.19; 29/402.16

(58) Field of Classification Search ..... 219/553, 219/121.65, 121.67; 427/253, 252, 250, 427/142, 287; 428/551; 29/889.1, 889.7, 29/889.72, 402.19, 402.16, 287
See application file for complete search history.

(56) References Cited

U.S. PATENT DOCUMENTS

| | | | | |
|---|---|---|---|---|
| 4,662,951 | A | 5/1987 | Brown et al. | |
| 4,705,203 | A | 11/1987 | McComas et al. | |
| 4,718,950 | A | 1/1988 | Nishikawa | |
| 4,726,104 | A | 2/1988 | Foster et al. | |
| 5,205,465 | A | 4/1993 | Bogard et al. | |
| 6,531,005 | B1 | 3/2003 | Bezerra et al. | |
| 6,560,870 | B2 * | 5/2003 | Das et al. | 29/889.1 |
| 6,673,169 | B1 | 1/2004 | Peterson, Jr. et al. | |
| 6,884,964 | B2 | 4/2005 | Murphy | |
| 6,916,387 | B2 | 7/2005 | Lulofs | |
| 7,051,435 | B1 | 5/2006 | Subramanian et al. | |
| 7,137,544 | B2 | 11/2006 | Caddell, Jr. et al. | |

FOREIGN PATENT DOCUMENTS

| | | |
|---|---|---|
| DE | 38 22 883 | 1/1990 |
| EP | 0 234 200 | 9/1987 |
| EP | 1 256 635 | 11/2002 |
| JP | 61-67719 | 4/1986 |
| JP | 61-067719 | * 4/1986 |
| JP | 2002-361470 | 12/2002 |

OTHER PUBLICATIONS

Li, J.H. et al., "Infrafred Heat Treatment of Ti-6Al-4V With Electroplated Cu," Journal of Materials Engineering and Performance, Aug. 2004, vol. 13, No. 4, pp. 445-450.

* cited by examiner

*Primary Examiner* — Shawntina Fuqua
(74) *Attorney, Agent, or Firm* — Kinney & Lange, P.A.

(57) ABSTRACT

Systems and methods for providing localized heat treatment of metal components are provided. In this regard, a representative method includes: identifying a portion of a metal component to which localized heat treatment is to be performed; shielding an area in a vicinity of the portion of the metal component; and directing electromagnetic energy in the infrared (IR) spectrum toward the portion of the metal component such that the portion is heated to a desired temperature and such that the area in the vicinity of the portion that is subjected to shielding does not heat to the temperature desired for the heat treatment.

13 Claims, 4 Drawing Sheets

SYSTEMS AND METHODS FOR PROVIDING LOCALIZED HEAT TREATMENT OF METAL COMPONENTS

BACKGROUND

1. Technical Field

The disclosure generally relates to repair of metal components.

2. Description of the Related Art

The manufacture, service and/or repair of metal components, such as gas turbine engines, oftentimes require localized heating of specified areas of the components. This can be done, for example, to allow for stress relief, metal forming and/or brazing applications. Localized heating is preferred when processing the entire component in an isothermal heat treatment oven could adversely affect the metallographic properties of the materials of the component, or for larger parts that might warp or otherwise deform during heat treatment.

In this regard, prior art localized heating methods include resistance and induction heating. Induction heating methods tend to be costly, afford little process control, and require extensive experience of an operator in order to match induction coils to both the induction generator and the component/cross sectional area being heated. In contrast, resistance heating is somewhat limited in that the power supplies are current matched to specific heating element designs. The necessity in the prior art of matching the power supplies and the heating elements has typically resulted in rather generic heating assemblies in the form of blankets that typically are much larger than the areas that require heating.

SUMMARY

Systems and methods for providing localized heat treatment of metal components are provided. In this regard, a representative embodiment of such a method comprises: identifying a portion of a metal component to which localized heat treatment is to be performed; shielding an area in a vicinity of the portion of the metal component; and directing electromagnetic energy in the infrared (IR) spectrum toward the portion of the metal component such that the portion is heated to a desired temperature and such that the area in the vicinity of the portion that is subjected to shielding does not heat to the temperature desired for the heat treatment.

An embodiment of a system for providing localized heat treatment of metal components comprises: a non-oxidizing environment positioned about at least a portion of a component that is to be heat treated; a heating device having an infrared (IR) heating element operative to propagate electromagnetic energy in the IR spectrum responsive to an electrical input; and a shield positioned to obstruct a line-of-sight between the IR heating element and an area of the component located adjacent the portion that is to be heat treated.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views. While several embodiments are described in connection with these drawings, there is no intent to limit the disclosure to the embodiments disclosed herein. On the contrary, the intent is to cover all alternatives, modifications and equivalents.

DETAILED DESCRIPTION

As will be described in detail here with respect to several exemplary embodiments, systems and methods for providing localized heat treatment of metal components are provided. It should be noted that although representative implementations will be described herein with reference to heat treatment of gas turbine engine components, various other components could be heat treated using similar techniques.

Figure 1:
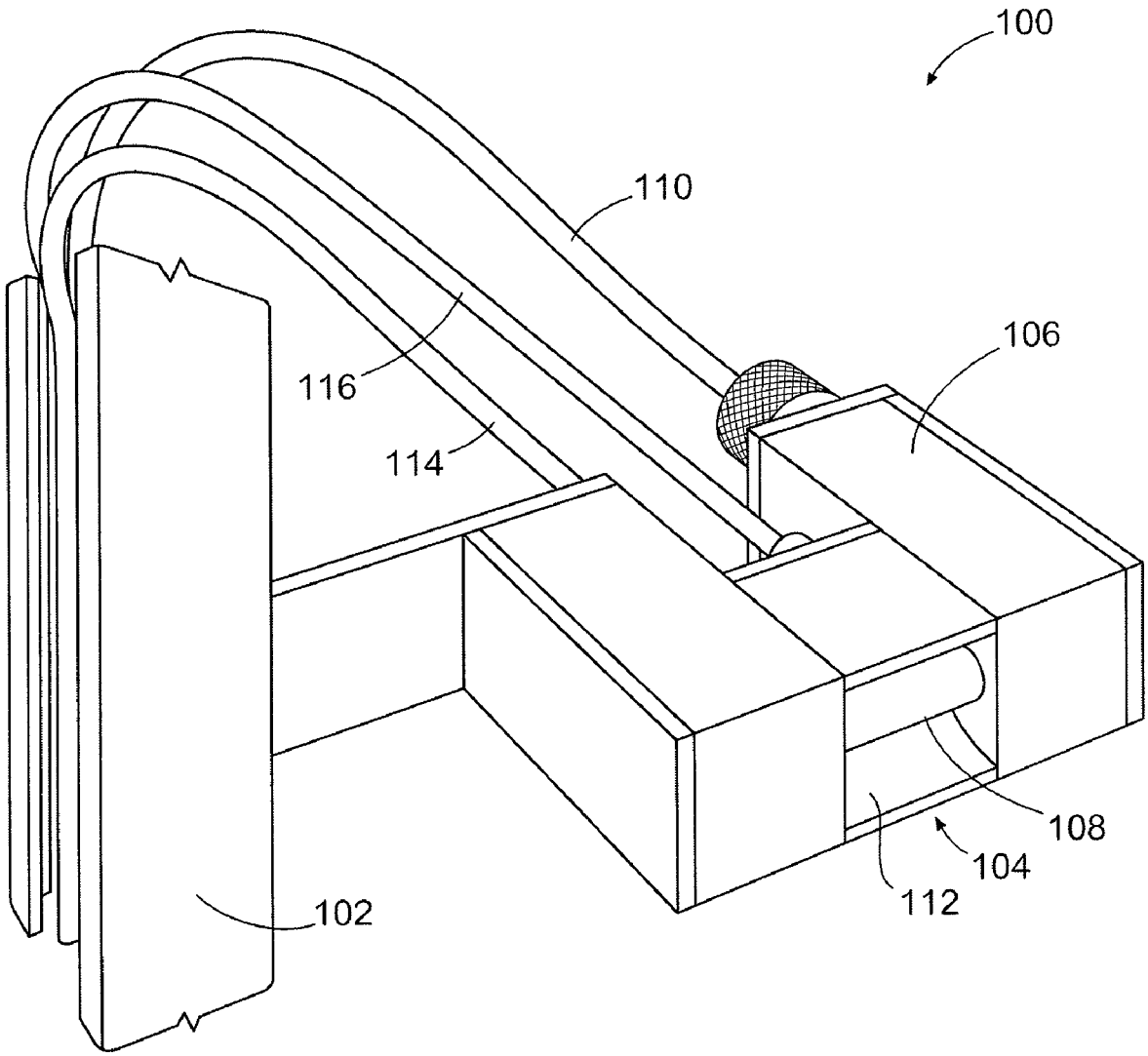
FIG. 1 is a schematic view of an embodiment of an infrared heating assembly.

In this regard, FIG. 1 depicts an exemplary embodiment of an infrared heating assembly 100. As shown in FIG. 1, assembly 100 generally includes a mounting arm 102 and a heating device 104. The heating device incorporates a housing 106 that mounts an mounts an element 108. Element 108 emits electromagnetic energy in the infrared (IR) spectrum responsive to electrical input provided by cable 110. A mirror 112, such as a parabolic mirror, is located within the housing to direct the IR energy outwardly from the housing. Selection of a suitable element is based, at least in part, on the range of temperatures desired for heat treating a component.

Mounting arm 102 enables the heating device 104 to be positioned so that the energy emitted by the element 108 can be directed toward an area of a component that is to be heat treated. In some embodiments, the mounting arm exhibits an articulated configuration to enable such positioning. Notably, the ability to manipulate positioning of the heating device via the mounting arm may make heat treatment of components possible without necessitating removal of such components from an assembly. By way of example, if the component that is to be heat treated is a portion of a turbine casing, the casing may not need to be removed from a nacelle to which the casing is mounted.

In the embodiment of FIG. 1, optional input and output coolant lines 114 and 116, respectively, provide a flow of liquid coolant to the heating device 104. The flow of coolant prevents excess heat from damaging the heating device. Additionally or alternatively, various other types of cooling can be used, such as air cooling provided by fans.

The embodiment of FIG. 1 is designed to provide localized heating to a substantially contiguous area. However, various other embodiments can provide simultaneous localized heating of areas that are spaced from each other. Notably, in some embodiments, this can be accomplished by providing an array of elements in a single heating device and/or by using multiple heating devices during a heat treatment, for example.

Figure 2:
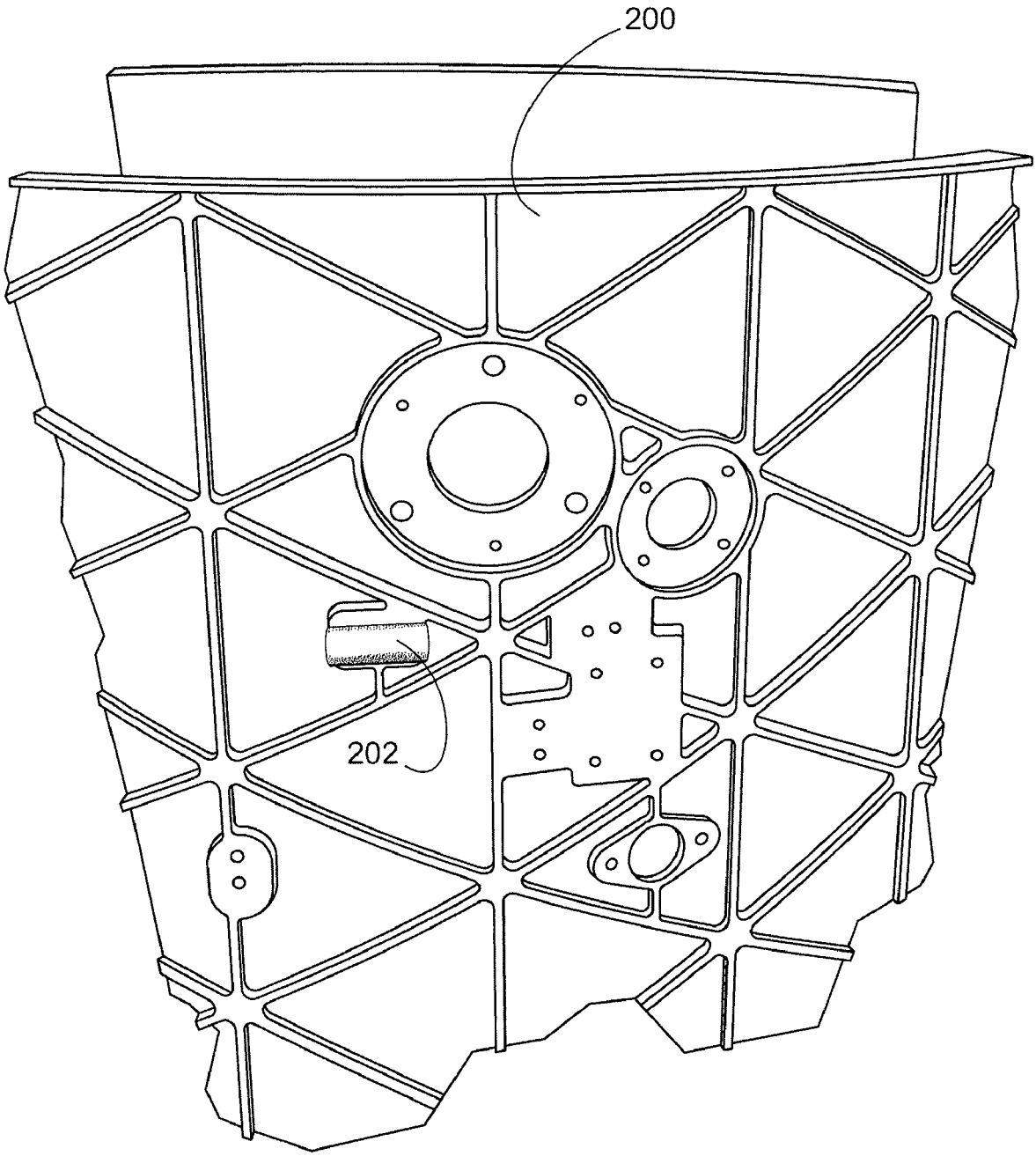
FIG. 2 is a schematic diagram depicting an embodiment of a section of a gas turbine engine with heat shielding positioned adjacent a selected portion that is to be heat treated.

As shown in FIG. 2, a section of gas turbine engine casing 200 formed of Titanium is provided that includes a weldrepaired flange 202. Localized heating of the flange is desired in order to relieve stresses in the material associated with the flange. In this regard, reference is made to FIG. 3, which depicts an embodiment of an infrared heating assembly 300 that is positioned to perform such heat treating.

Figure 3:
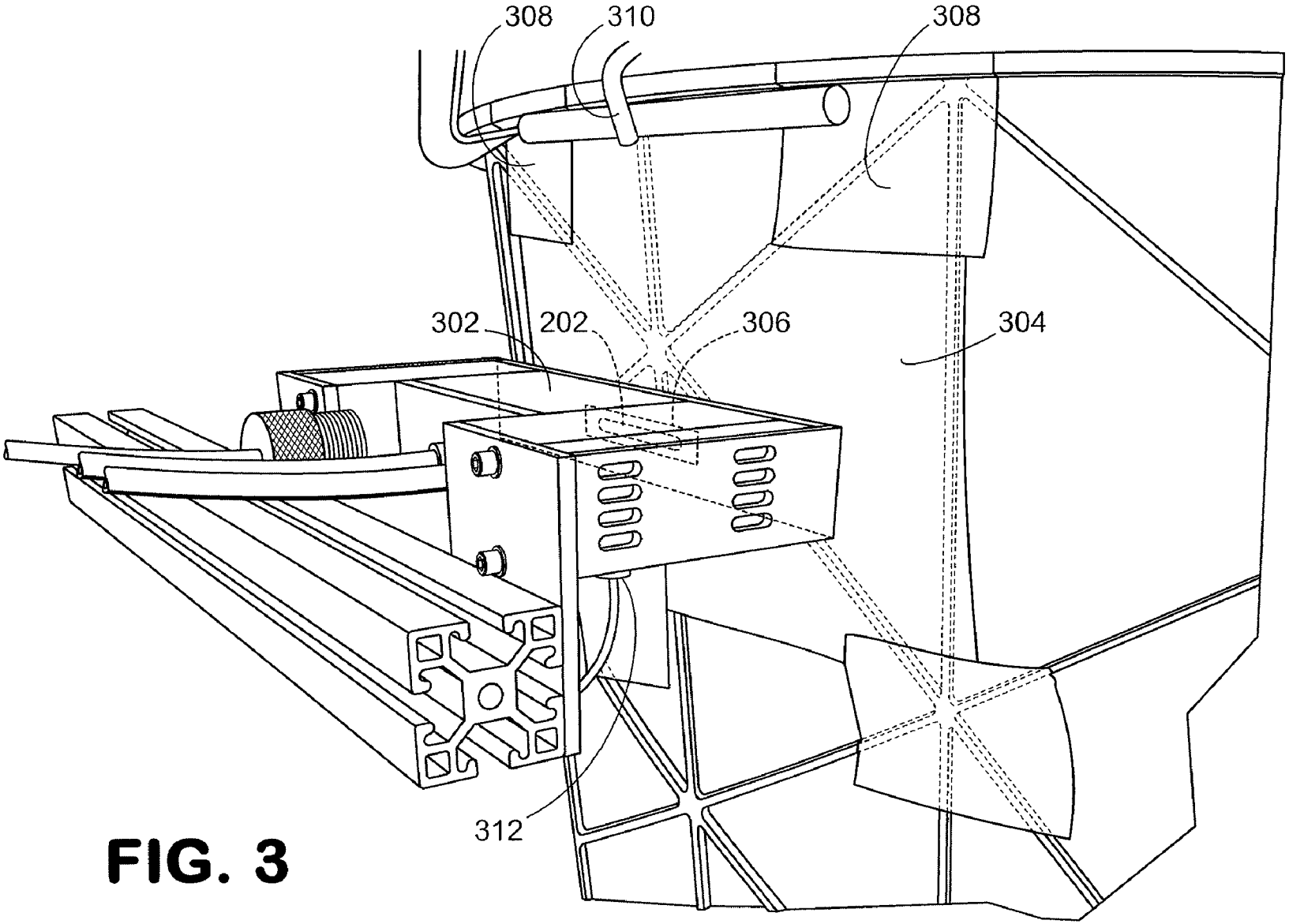
FIG. 3 is a schematic diagram depicting the section of gas turbine engine of FIG. 2, with an embodiment of an infrared heating device positioned to locally heat the selected portion.

As shown in FIG. 3, assembly 300 is positioned so that the heating device 302 directs IR energy toward the flange 202. Note that the heating device is not attached to the casing, as would typically occur during a resistance or inductive heating process. This is because the IR energy is propagated through free space from the heating device toward the flange, thereby rendering physical attachment of the heating device and the casing unnecessary.

Also shown in FIG. 3 is a shield 304 that inhibits IR energy from excessively heating material that is not intended to be heat treated. In this embodiment, shield 304 is formed of a sheet of Titanium that incorporates a cut-out 306.

The shield is positioned so that the cut-out is aligned with the flange, thereby enabling a line-of-sight to be established between the element of the heating device and the flange. As shown in the embodiment of FIG. 3, positioning of the shield can be accomplished using metal foil 308 (e.g., Titanium foil) to attach the shield to the casing. In other applications, various clamps and/or other attachment techniques can be used. For instance, in some applications, a shield can be held in position by gravity and/or coordinating shapes of the shield and the component, thereby rendering the use of additional attachment components unnecessary.

In some embodiments, a metallic foil interface (not shown) can be used between the heating element and component that is to be heated in order to establish more uniform temperature gradients. Of particular interest is using Titanium foil with Titanium components. Such a technique may not only help with the temperature gradients, but also can be useful as a gettering device to absorb contaminates that may out-gas from the element and component during heat-up. In the embodiment of FIG. 3, however, a metallic foil interface is not use. Instead, a purge gas line 310 is provided to vent unwanted gasses generated by the heat treatment.

A thermocouple 312 is attached to the casing in a vicinity of the heat treatment. The thermocouple enables monitoring of the casing temperature to ensure that the heat treatment is performed as desired.

Figure 4:
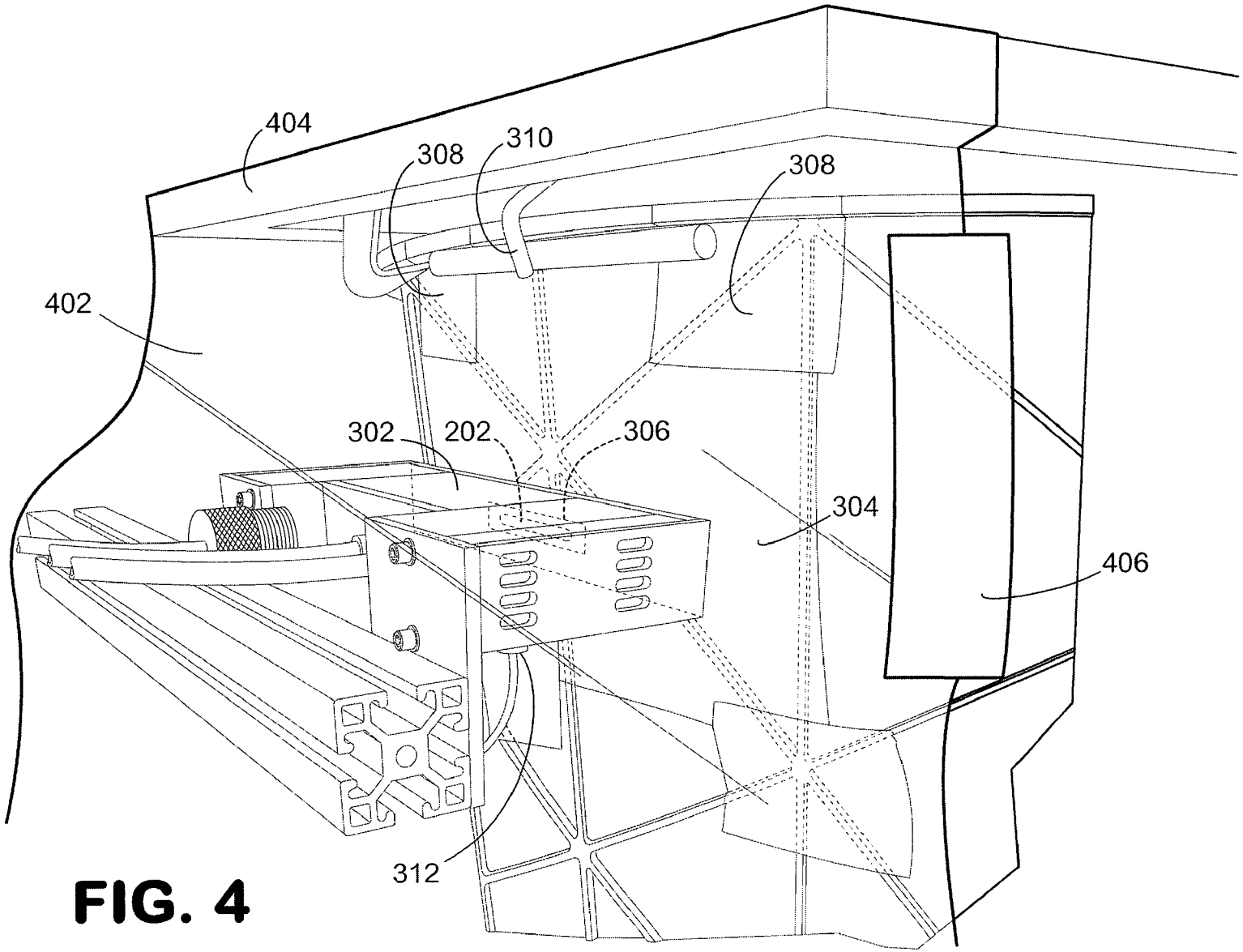
FIG. 4 is a schematic diagram the section of gas turbine engine of FIG. 2, with an embodiment of an enclosure positioned about the selected portion that is being heat treated to provide a non-oxidizing environment.

As shown in FIG. 4, at least the portion of the casing that is to be heat treated is located within a non-oxidizing environment. By way of example, such an environment can be formed by a heat resistant enclosure 402 that is flooded with an inert gas, such Argon. Argon may be deemed suitable in some applications because Argon is heavier than air. Thus, depending upon the configuration of the containment being used and the location of the component that is to be heat treated, a gas that is denser than air may be helpful. This is because the gas tends to sink to the bottom of the containment, thereby displacing oxygen from the lower portions of the containment that may surround the area that is to be heat treated.

In other embodiments, other gasses can be used, with the selection of such gasses being based, at least in part, on the materials being treated. For instance, for some materials, a gas such as Nitrogen could be used. In still other embodiments, the heat resistant enclosure could be a vacuum chamber designed to be evacuated of oxygen.

In the embodiment of FIG. 4, enclosure 402 is formed in part by the casing that is to be heat treated and in part by a flexible material. In particular, the material is a transparent vinyl, e.g., polyvinyl chloride sheeting (such as manufactured by Polmershapes™), which facilitates visual monitoring of the heating process. The transparent vinyl is draped over an optional support frame 404 and tape 406 is used to form a seal between the flexible material and the casing.

Additionally or alternately, a cooling device (not shown) can be used to provide localized cooling, such as to areas adjacent to those areas that are to be heat-treated. In some embodiments, the cooling device can be a cooling fan and/or a closed-loop cooling system, such as one that uses a liquid (e.g. water), for providing cooling.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A system for providing localized heat treatment of metal components, said system comprising:

a non-oxidizing environment positioned about at least a portion of a component that is to be heat treated, the non-oxidizing environment being provided by an enclosure that is operative to receive a flow of gas such that oxygen is purged from about the component during heat treatment;

a heating device having an infrared (IR) heating element operative to propagate electromagnetic energy in the IR spectrum responsive to an electrical input;

a shield positioned to obstruct a line-of-sight between the IR heating element and an area of the component located adjacent the portion that is to be heat treated; and a gas purge line having an inlet positioned within the enclosure and being operative to draw out-gasses, generated by the heat treatment, from the enclosure.

2. The system of claim 1, wherein the enclosure comprises a transparent material.

3. The system of claim 1, wherein the gas is an inert gas.

4. The system of claim 1, wherein the component comprises Titanium and the shield is formed of Titanium sheet material.

5. The system of claim 1, wherein the shield is formed of a sheet of metal having a cut-out sized and shaped to accommodate placement of the portion of the component that is to be heat treated such that a line-of-sight can be established between the portion and the IR heating element when the shield is in place.

6. The system of claim 1, wherein the heating device comprises a housing and parabolic mirror, the parabolic mirror and the IR heating element being located within the housing such that IR energy from the IR heating element is directed outwardly from the housing by the parabolic minor.

7. The system of claim 1, further comprising means for cooling the heating device.

8. The system of claim 7, wherein the means for cooling comprises a closed-lop liquid cooling unit.

9. A method for providing localized heat treatment of metal components, said method comprising:

identifying a portion of a metal component of a gas turbine engine to which localized heat treatment is to be performed in a non-oxidizing environment by constructing an enclosure about the portion that is to be heat treated and urging a volume of gas to purge the enclosure of oxygen, the portion of the component comprising a weld and the heat treatment is performed to reduce stresses in the component associated with the weld, the heat treatment being performed while the gas turbine, including the component, is mounted to a nacelle;

shielding an area in a vicinity of the portion of the metal component;

using a gas purge line having an inlet positioned within the enclosure to draw out-gasses, generated by the heat treatment, from the enclosure; and directing electromagnetic energy in the infrared (IR) spectrum toward the portion of the metal component such that the portion is heated to a desired temperature and such that the area in the vicinity of the portion that is subjected to shielding does not heat to the temperature desired for the heat treatment by placing the shield to obstruct line-of-sight between the directed electromagnetic energy in the infrared (IR) spectrum and the identified portion of the metal component being heat treated.

10. The method of claim 9, wherein the component is a turbine casing.

11. The method of claim 9, further comprising purging the enclosure of out-gasses generated by the heat treatment.

12. The method of claim 9, wherein the component comprises Titanium and the shield is formed of Titanium sheet material.

13. The method of claim 9, wherein: directing electromagnetic energy is performed by a heating device; and the method further comprises actively cooling the heating device during the heat treatment.

* * * * *